US007896109B2

(12) United States Patent
Lin

(10) Patent No.: US 7,896,109 B2
(45) Date of Patent: Mar. 1, 2011

(54) SPACER RING FOR ELASTOMERIC SEAL

(75) Inventor: Chih Lin, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 85 days.

(21) Appl. No.: 12/251,000

(22) Filed: Oct. 14, 2008

(65) Prior Publication Data

US 2010/0089657 A1 Apr. 15, 2010

(51) Int. Cl.
*E21B 10/25* (2006.01)

(52) U.S. Cl. ..... 175/371

(58) Field of Classification Search ..... 175/371, 175/359; 277/935; 384/94
See application file for complete search history.

(56) References Cited

U.S. PATENT DOCUMENTS

| | | | | |
|---|---|---|---|---|
| 3,718,338 | A * | 2/1973 | Traub | 277/584 |
| 4,428,588 | A * | 1/1984 | Oelke | 175/371 |
| 4,429,854 | A | 2/1984 | Kar et al. | |
| 4,448,268 | A | 5/1984 | Fuller | |
| 4,793,424 | A * | 12/1988 | Lim, Jr. | 175/228 |
| 6,196,339 | B1 * | 3/2001 | Portwood et al. | 175/371 |
| 6,536,542 | B1 | 3/2003 | Fang et al. | |
| 6,679,342 | B2 | 1/2004 | Portwood et al. | |
| 6,789,634 | B1 | 9/2004 | Denton | |
| 6,820,704 | B2 * | 11/2004 | Mourik et al. | 175/371 |
| 6,837,317 | B2 | 1/2005 | Byrd | |
| 6,948,715 | B2 * | 9/2005 | Taylor et al. | 277/603 |
| 7,000,712 | B2 | 2/2006 | Byrd | |
| 7,117,961 | B2 | 10/2006 | Yong et al. | |
| 7,461,708 | B2 * | 12/2008 | Yong et al. | 175/371 |
| 2003/0029645 | A1 | 2/2003 | Mourik et al. | |
| 2006/0032673 | A1 * | 2/2006 | Yong et al. | 175/372 |
| 2008/0099244 | A1 * | 5/2008 | Chellappa et al. | 175/57 |
| 2008/0121436 | A1 * | 5/2008 | Slay et al. | 175/371 |
| 2009/0038858 | A1 * | 2/2009 | Griffo et al. | 175/371 |
| 2009/0114452 | A1 * | 5/2009 | Gallifet | 175/371 |

* cited by examiner

*Primary Examiner*—Daniel P Stephenson
(74) *Attorney, Agent, or Firm*—Bracewell & Giuliani LLP

(57) ABSTRACT

A roller cone bit is provided that includes a companion ring positioned adjacent to the seal, wherein the companion ring is formed of a porous material that is compatible with the fluid lubricating the interface between the roller cone and the bearing pin.

20 Claims, 4 Drawing Sheets

SPACER RING FOR ELASTOMERIC SEAL

BACKGROUND OF THE INVENTION

1. Field of the Invention

This invention relates in general to earth-boring rotary cone drill bits and in particular to a protective device for protecting the seal of the cone from damage due to debris.

2. Description of Related Art

Earth-boring bits of the type described herein include a bit body having at least one bearing pin, normally three, and a cone rotatably mounted to each bearing pin. Each cone includes cutting elements for engaging the earth formation as the bit body rotates. The bearing spaces between the cavity of the cone and the bearing pin are typically filled with a lubricant. A seal is located near the mouth of the cone cavity for the purpose of sealing lubricant from drilling fluid.

During typical drilling operations, debris, whether it originates from within the drill bit or from the bore hole, can find its way to the seal and cause wear, which in turn can eventually lead to the failure of the seal. One type of seal includes an elastomeric member having an inner diameter in sliding engagement with the bearing pin and an outer diameter that is normally in static engagement with the cone. This type of seal can form a nip area with the bearing pin and allows debris to accumulate near and migrate into the sealing interface. The accumulated debris can cause wear and leakage. In addition, drilling mud or fluid to remove cuttings are circulated at high velocity and can contribute to the degradation of seals. The drilling fluid can include abrasive cuttings which continuously erode the surfaces of the drill bit.

Another type of seal used in drill bits employs primary metal-to-metal face seals that are energized by an elastomeric ring. One type of seal assembly employs a secondary elastomeric seal exterior of the energizer ring to protect the primary seal. The secondary seal takes up precious space, and the assembly requires pressure compensation for the space between the two seals.

Other designs use an elastomeric ring that has a more wear-resistant elastomeric layer upon the inner diameter. The more wear-resistant layer may comprise a different elastomer, or it may be made up of a wear-resistant fabric.

Thus, there exists a need to provide an improved seal for a roller cone drill bit whereby wear and leakage may be minimized.

SUMMARY OF THE INVENTION

In this invention, a companion ring formed of porous material is positioned between the seal and a side surface of the seal area to prevent the incursion of drill cuttings to the drill bit.

In one aspect, an earth boring bit is provided having a bit body that includes a depending bearing pin. The bit includes a cone having a plurality of cutting elements for engaging a bore hole, wherein the cone includes a cavity that rotatably engages the bearing pin. The cone and the bearing pin include a seal area defined by two annular surfaces, one of which rotates relative to the other. The bit includes a seal that includes a forward side surface and a rearward side surface. The seal is positioned between the bearing pin and the cone cavity in sealing engagement with the annular surfaces of the seal area; and a companion ring abutting one of the side surfaces of the seal and positioned between the bearing pin and the cone cavity in non-sealing engagement with the annular surfaces of the seal area, wherein the companion ring is a permeable material.

In certain embodiments, the permeable material that includes a fluid compatible with the lubricant lubricating the interface between the bearing pin and the cone cavity. In certain other embodiments, the permeable material is impregnated with a fluid that is compatible with the lubricant lubricating the bearing pin.

In another aspect, an earth boring bit is provided that includes a bit body having a depending bearing pin, and a cone having a plurality of cutting elements for engaging a bore hole. The cone includes a cavity that rotatably engages the bearing pin. A groove having a forward side surface, a rearward side surface and a base is formed in the cavity of the cone, and includes a seal in the groove between the bearing pin and the cone. The seal includes a forward side surface and a rearward side surface and has an outer diameter that sealingly engages the base of the groove and an inner diameter that sealingly engages the bearing pin. At least one companion ring is adjacent to the side surface of the seal. The companion ring is formed of a permeable material. The height of the groove is greater than the combined height of the seal and the companion ring.

In certain embodiments, the permeable material is compatible with a lubricant operable for lubricating the interface between the bearing pin and the cone cavity.

In another aspect, an earth boring bit is provided that includes a bit body having a depending bearing pin and a cone having a plurality of cutting elements for engaging a bore hole. The cone has a cavity that rotatably engages the bearing pin, and the cone and the bearing pin have a seal area defined by two annular surfaces, one of which rotates relative to the other. The bit includes an elastomeric seal having a forward side surface, a rearward side surface and is positioned between the bearing pin and the cone cavity in sealing engagement with the annular surfaces of the seal area. The bit includes a first companion ring abutting the forward side surface of the seal and positioned between the bearing pin and the cone cavity in non-sealing engagement with the annular surfaces of the seal area, wherein the first companion ring is foam material. The bit also includes a second companion ring abutting the rearward side surface of the seal and positioned between the bearing pin and the cone cavity in non-sealing engagement with the annular surfaces of the seal area, wherein the second companion ring is felt material.

In another aspect a method of sealing drilling fluid from lubricant in an earth boring drill bit having a cone rotatably mounted on a bearing pin for engaging a borehole is provided that includes the steps of providing a seal area between the cone and the bearing pin defined by two annular surfaces, one of which rotates relative to the other. A seal that includes a forward side surface, a rearward side surface, at least one dynamic seal surface and a least one static seal surface and a companion ring are located between the annular surfaces. The companion ring includes a porous material and is in non-sealing engagement with the seal are. The method further includes rotating the cone on the bearing pin within a borehole and sealing drilling fluid in the borehole from lubricant with a dynamic seal surface of the seal and companion ring, and blocking at least a portion of any drilling fluid or debris that contacts the companion ring from migrating past the companion ring.

In certain embodiments, the companion ring is impregnated with a fluid that is compatible with the lubricant lubricating the bearing pin.

DETAILED DESCRIPTION

Figure 1:
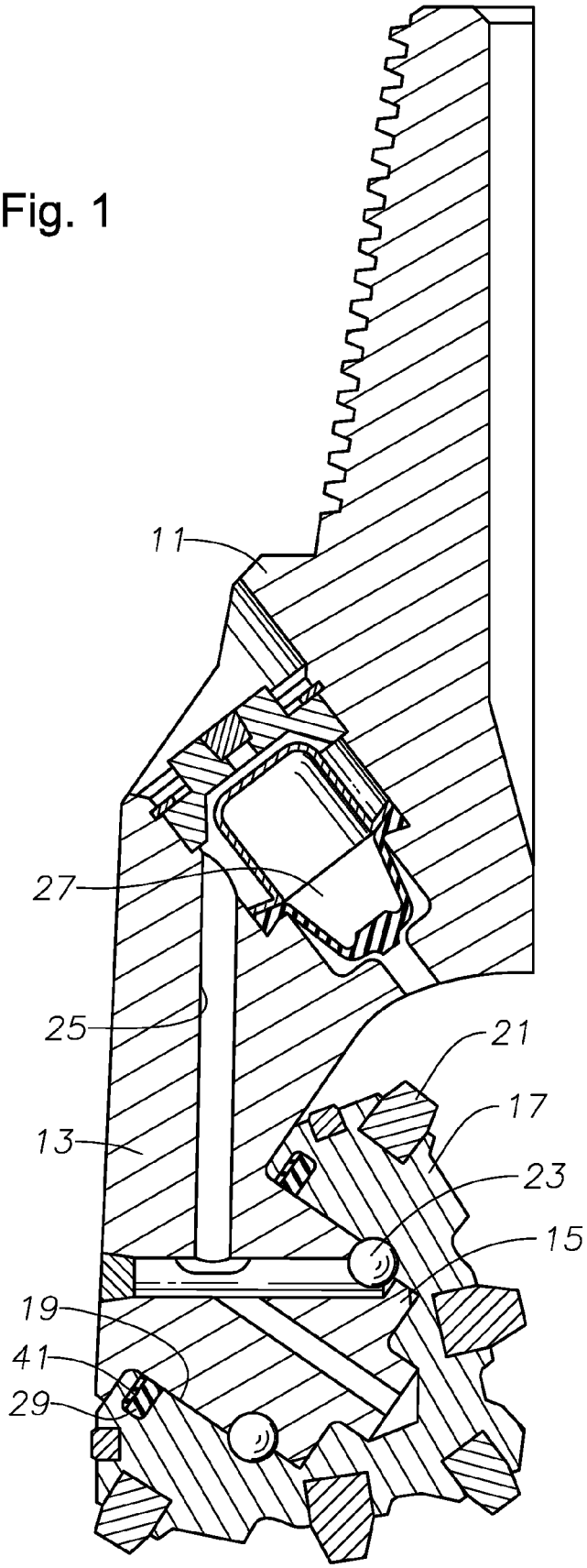
FIG. 1 is a partial cross sectional view of a roller cone drill bit having a seal in accordance with one embodiment of the invention.

Referring to FIG. 1, the drill bit has a bit body 11 that includes at least one bit leg 13. In certain embodiments, the body 11 includes three bit legs 13. A bearing pin 15 depends downward and forward from each bit leg 13 toward the axis of rotation of the bit. A cone 17 has a cavity 19 that slides over bearing pin 15, allowing cone 17 to rotate relative to bearing pin 15. Cone 17 has a plurality of cutting elements 21 on its exterior. Cutting elements 21 may be tungsten carbide inserts pressed into mating holes, or cutting elements 21 may comprise teeth integrally machined from the body of cone 17. Cone 17 is held on bearing pin 15 by a locking element, which in one embodiment can include a plurality of balls 23 located in mating annular grooves of bearing pin 15 in cone cavity 19.

A lubricant passage 25 extends through each bit leg 13 from a compensator 27 to the bearing spaces within cavity 19. A seal 29 is provided to seal lubricant within the bearing spaces. Compensator 27 reduces the pressure differential across seal 29, which is exposed to borehole pressure on its rearward side and lubricant pressure on its forward side. The surfaces between the bearing pin 15 and the cone 17 are lubricated by grease. The grease fills the regions adjacent to the bearing surfaces and fills various interconnected passageways. The bit includes a grease reservoir, including a pressure compensation subassembly 27 and a lubricant cavity 25, which is connected to the ball passageway by a lubricant passageway. The grease is retained in the bearing structure and the various passageways by means of seal assembly 29. Additionally, seal 29 prevents drilled cuttings and drilling fluid from passing the seal and washing out the lubricant and damaging the bearing surfaces. In certain embodiments, companion ring 41 is in non-sealing engagement with the seal area.

Figure 2:
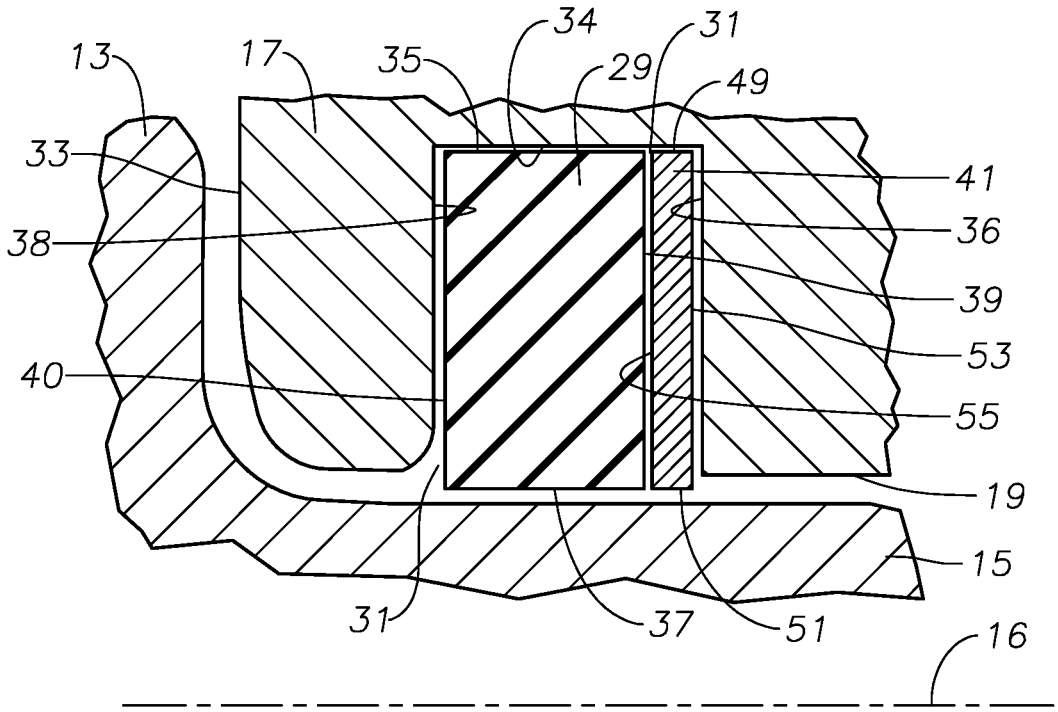
FIG. 2 is a partial cross sectional view of a seal in accordance with one embodiment of the invention.

Referring to FIG. 2, one embodiment of an improved seal is provided. Seal 29 is located within seal groove 31 formed in cone cavity 19. Seal groove 31 is perpendicular to the axis 16 of bearing pin 15 and includes a cylindrical base 34 and parallel flat side walls, which include a forward side surface 36 of the seal groove and a rearward side surface 38 of the seal groove. Seal groove 31 is located a short distance within cavity 19. Cone 17 has a back face 33 that surrounds the mouth of cavity 19. Companion ring 41 is located within seal groove 31 between seal 29 and forward side surface 36 of the seal groove. In certain embodiments, companion ring 41 provides positional stability for the seal 29, thereby restricting or preventing axial movement of the seal within the seal groove 31.

Seal 29 can include an elastomeric ring having an outer diameter 35 and an inner diameter 37. In certain embodiments, the outer diameter 35 and inner diameter 37 of the seal 29 are generally cylindrical. In certain embodiments, forward side surface 39 and rearward side surface 40 of seal 29 are generally flat. In other embodiments, the forward side surface 39 and rearward side surface 40 of seal 29 have a generally round profile. Other shapes for seal 29 are also feasible. While FIG. 2 generally shows a high aspect ratio seal and corresponding companion ring, it is understood that in other embodiments a seal having a substantially round cross section may also be used.

Companion ring 41 is a porous material forming a ring having an outer diameter 49 that contacts seal groove base 34 and an inner diameter 51 that contacts bearing pin 15. In certain embodiments, outer diameter surface 49 and inner diameter surface 51 are generally cylindrical. In other embodiments, outer diameter surface 49 and inner diameter surface 51 are generally straight when viewed in cross-section. In certain embodiments, forward side surface 53 of companion ring 41 and rearward side surface 55 of companion ring are generally straight. In certain embodiments, forward side surface 53 of companion ring 41 and rearward side surface 55 of companion ring are generally arcuate. In certain embodiments, the height of companion ring 41 between forward side surface 53 and rearward side surface 55 is less than the height of seal 29. In certain embodiments, the height of companion ring 41 is less than the distance between the outer diameter of the companion ring 49 and the inner diameter of the companion ring 51. Generally, the companion ring 41 is disposed between the bearing pin 15 and the seal groove base 34 without forming a seal. In certain embodiments, rearward side surface 55 of the companion ring 41 and seal forward side surface 39 abut each other. The height of seal groove 31 can be greater than the height of companion ring 41 and seal 29. In certain embodiments, companion ring 41 does not exert lateral force to seal 29.

In certain embodiments, the companion ring is permeable to liquids. In certain embodiments, the companion ring 41 is a porous material includes a liquid that is compatible and/or miscible with the lubricant or grease that is used to lubricate the interface between the bearing pin 15 and the cone cavity 19. As used herein, compatible means that the liquid does not interfere, disrupt, harm or diminish the performance of the lubricant. The companion ring 41 may be soaked or impregnated with a fluid compatible with the rock bit grease, such as for example, but not limited to, calcium complex containing rock bit grease, lithium complex containing rock bit grease, and the like, as well as perfluoropolyether and perfluoroalkylpolyether lubricants, such as for example, the Krytox® lubricants manufactured by DuPont, and the like. In certain embodiments, the porous material is permeable to a liquid miscible with the grease or lubricant used to lubricate the interface between the bearing pin 15 and the cone 19. Preferably, the companion ring 41 is soaked or impregnated prior to installation. Preferably, companion ring 41 comprises a material that is chemically and thermally stable. In certain embodiments, companion ring 41 can be made from a variety of materials, including but not limited to, fibrous materials, polyethylene microfibers, polypropylene microfibers, polyester, fiberglass materials, polyesters, polyethylene terephthalate/polypropylene composite materials, and the like. In certain embodiments, companion ring 41 can be made from air filter media of various densities. In certain preferred embodiments, companion ring 41 is deformable. In certain embodiments the companion ring material can absorb up to at least three times its weight of a fluid compatible with the lubricant. In certain other embodiments, the companion ring material can absorb at least 6 times its weight of a fluid compatible with the lubricant. In certain preferred embodiments, the companion ring is a foam material. In certain embodiments, when the companion ring is impregnated with a fluid compatible with the lubricant, a closed cell foam material may be preferred. In certain embodiments, it is anticipated that a closed cell foam material may break and release the impregnated fluid, when subjected to an increased pressure. In certain embodiments, when the companion ring is soaked with a fluid compatible with the lubricant, an open cell foam material may be preferred.

Figure 3:
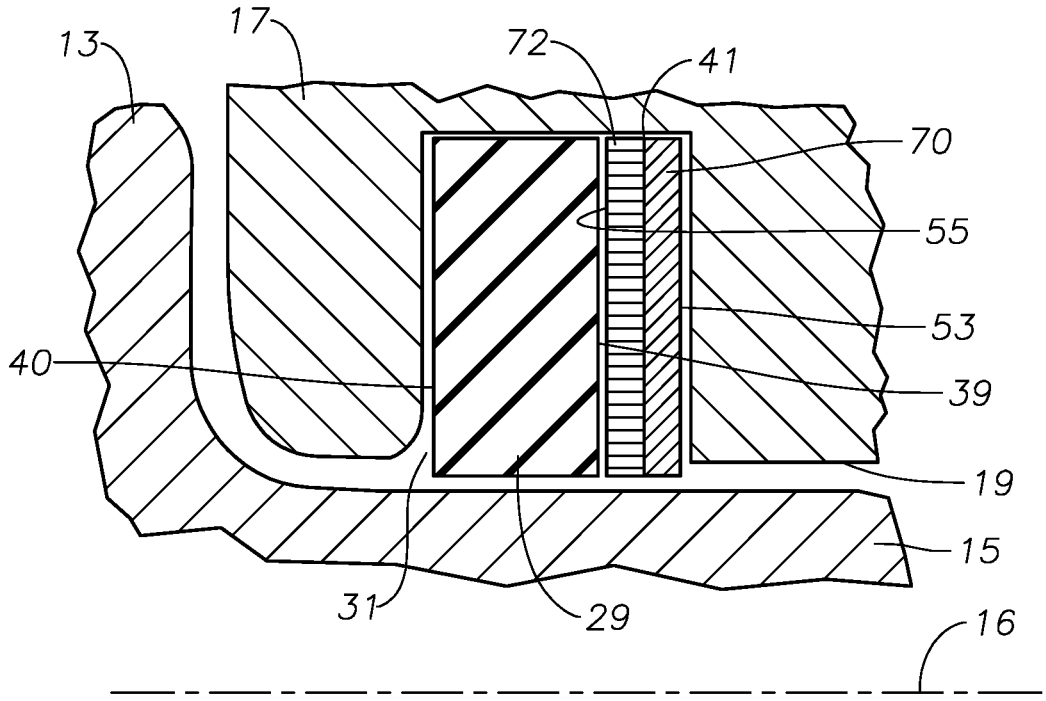
FIG. 3 is a cross sectional view of another seal in accordance with another embodiment of the invention.

In certain embodiments, as shown in FIG. 3, companion ring 41 can be composed of two materials of varying density that are bonded together. In alternate embodiments, the companion ring can be formed by two separate unbonded materials. The companion ring first material 70 can be a porous and/or absorbent material and the companion ring second material 72 can be more dense than the companion ring first material 72. In certain embodiments, the companion ring second material 72 can be less permeable to a lubricant compatible liquid than the companion ring first material 70. As noted previously, both the first and second materials can be soaked or impregnated with fluid compatible with the grease used to lubricate the interface between bearing pin 15 and the interior cavity of cone 19. Preferably, the companion ring 41 is soaked or impregnated prior to installation. In certain embodiments, the companion ring second material 72 is substantially denser than the companion ring first material 70. In certain other embodiments, the companion ring first material 70 is soaked with a fluid compatible with the lubricant or grease used to lubricate the interface between bearing pin 15 and cone cavity 19 and the companion ring second material 72 is not soaked with a fluid compatible with the grease used to lubricate the interface between bearing pin 15 and cone cavity 19. In certain embodiments, less porous second material 72 is substantially denser than the companion ring first material 70, and blocks drilling fluids and/or cuttings from migrating to the interface between bearing pin 15 and cone cavity 19. In certain embodiments, the height of companion ring 41 and the height of the seal 29 are less than the height of seal groove 31.

Figure 4:
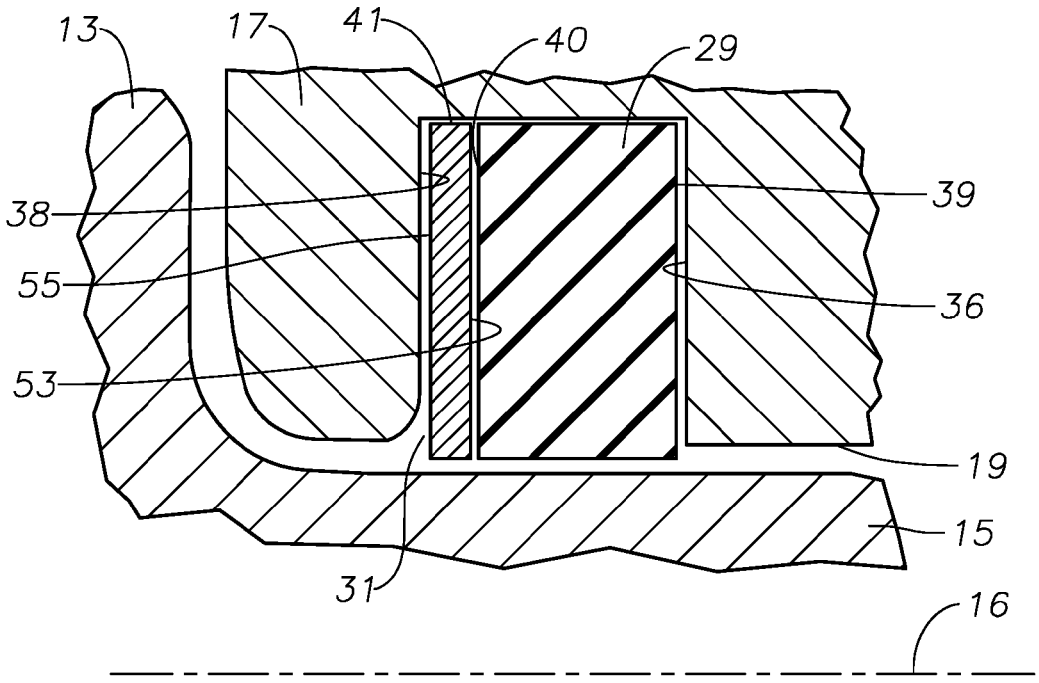
FIG. 4 is a cross sectional view of another seal in accordance with another embodiment of the invention.

In certain other embodiments, as shown in FIG. 4, companion ring 41 can be positioned between rearward side surface 40 of seal 29 and rearward side surface 38 of seal groove 31. Placement of the companion ring 41 between rearward side surface 40 of seal 29 and the rearward side surface 38 of seal groove 31 allows the companion ring to function as a debris trap and filter. As noted previously, in certain embodiments, companion ring 41 can be soaked or impregnated with a lubricant or grease compatible fluid. In certain other embodiments, the companion ring 41 is not soaked or impregnated prior to installation. In certain embodiments, the heights of companion ring 41 and the height of seal 29 are less than the height of seal groove 31.

Figure 5:
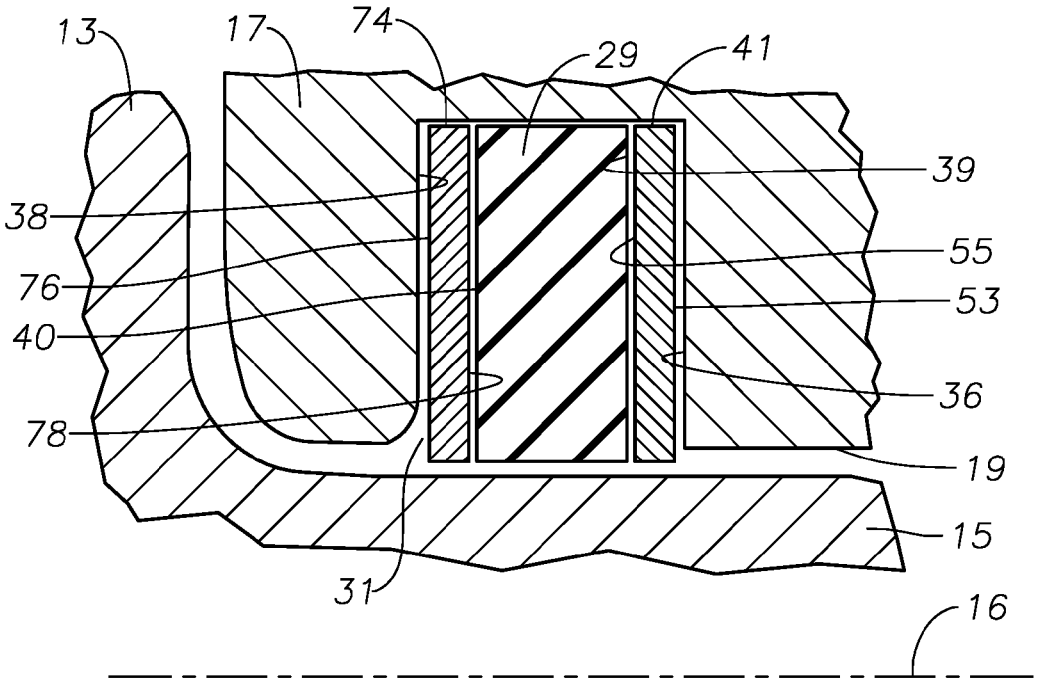
FIG. 5 is a cross sectional view of another seal in accordance with another embodiment of the invention.

In other embodiments, as shown in FIG. 5, two companion rings can be employed. First companion ring 41 can be positioned between forward side surface 39 of seal 29 and forward side surface 36 of seal groove 31, and second companion ring 74 can be positioned between rearward side surface 40 of seal 29 and rearward side surface 38 of seal groove 31. In certain embodiments, the heights of companion rings 41 and 74 and the height of seal 29 are less than the height of seal groove 31. In certain preferred embodiments, first companion ring 41 is soaked or impregnated with a fluid compatible with the lubricant prior to installation and second companion ring 74 is not soaked or impregnated prior to installation. In certain preferred embodiments, first companion ring 41 is a foam material and second companion ring 74 is a felt material.

Figure 6:
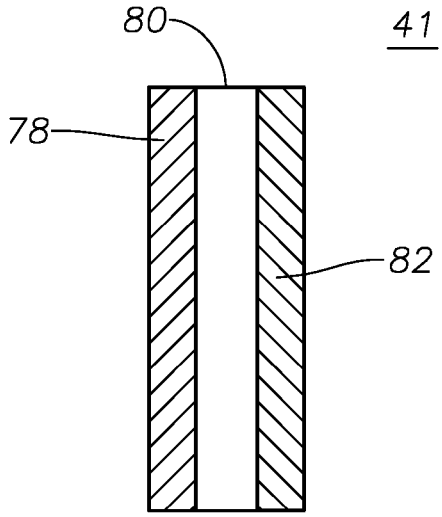
FIG. 6 is a cross sectional view of a seal in accordance with another embodiment of the invention.

In certain embodiments, as shown in FIG. 6, companion ring 41 can include layered structure. The layered structure can include a high density core 80 that is positioned between two low density layers 78 and 82, respectively. In certain embodiments, the high density material can be resistant to absorbing liquids. In certain embodiments, the high density material can be less porous than the low density material. In certain embodiments, the high density material can be resistant to aqueous based materials, such as for example, aqueous based drilling fluids. In certain embodiments, first low density layer 78 and second low density layer 82 are different materials. In certain other embodiments, first low density layer 78 and second low density layer 82 can be the same materials.

In certain embodiments, the porous media of the companion ring positioned between seal 29 and lubricant passage 25 functions in a manner such that the porous media retains and provides additional lubrication to the sliding surface between bearing pin 15 and seal 29. In certain embodiments, the movement of bearing pin 15 relative to cone cavity 19 causes an amount of grease to be squeezed from companion ring 41.

In certain embodiments, the interior surfaces of cone cavity 19 and bearing pin 15 can be coated with a wear resistant material, such as for example, tungsten, tungsten carbide, silicon carbide, hard facing or a like material or process. In certain embodiments, the companion ring 41 is a material that is wear resistant, or resistant to the movement of the cone cavity relative to the bearing pin.

In certain embodiments, the companion ring is a material that is compressible. In certain other embodiments, the companion ring may have a non uniform thickness.

In certain embodiments, companion ring 41 is an open cell permeable material. In other embodiments, companion ring 41 is a closed cell permeable material. In certain embodiments, companion ring 41 can be a closed cell material and the inner diameter of the companion ring that contacts the surface of bearing pin 15 may include a textured surface.

Figure 7:
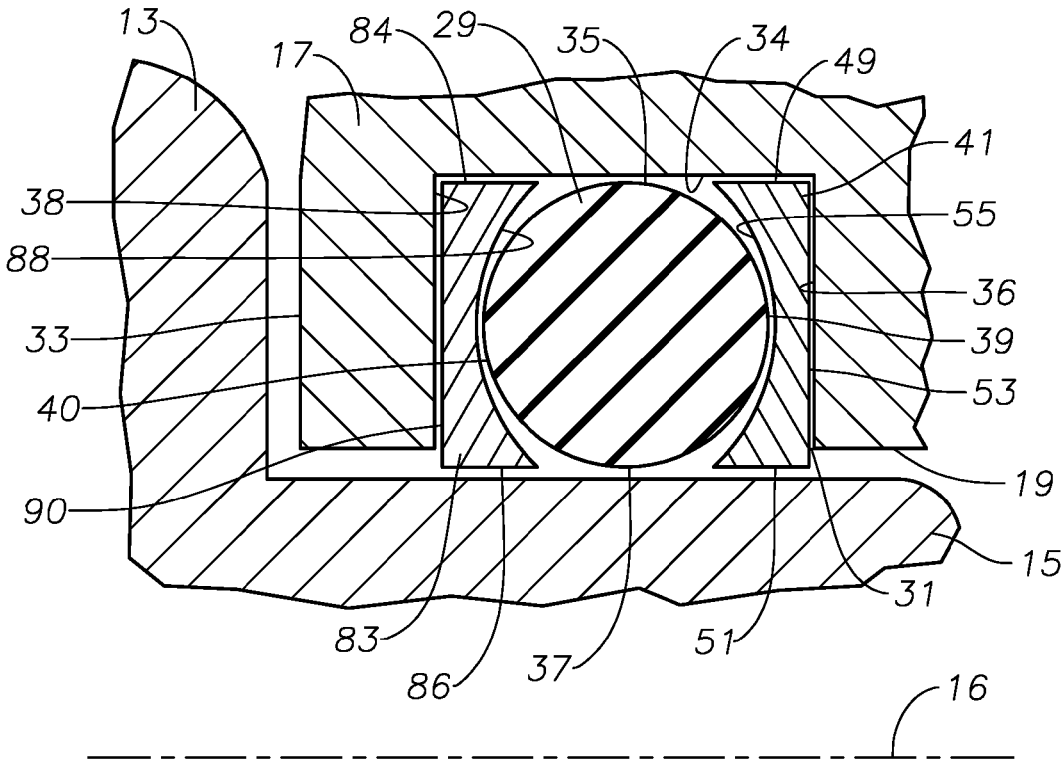
FIG. 7 is a cross sectional view of another seal in accordance with another embodiment of the invention.

Referring to FIG. 7, an embodiment of an improved seal is provided. Seal 29 is an o-ring having a substantially round cross-section located within seal groove 31 formed in cone cavity 19. Seal groove 31 is perpendicular to the axis of bearing pin 15 and includes a cylindrical base 34 and parallel flat side walls, which include a forward side surface 36 of the seal groove and a rearward side surface 38 of the seal groove. Seal groove 31 is located a short distance within cavity 19. Cone 17 has a back face 33 that surrounds the mouth of cavity 19. A first companion ring 41 is located within seal groove 31 between seal 29 and forward side surface 36 of the seal groove. Seal 29 can include an elastomeric ring having an outer diameter 35 and an inner diameter 37. As seal 29 is substantially round, it includes a curved forward side surface 39 and a curved rearward side surface 40.

First companion ring 41 is a porous material forming ring having an outer diameter 49 that contacts seal groove base 34 and an inner diameter 51 that contacts bearing pin 15. In certain embodiments, outer diameter surface 49 and inner diameter surface 51 are generally cylindrical. In other embodiments, outer diameter surface 49 and inner diameter surface 51 are generally straight when viewed in cross-section. Forward side surface 53 of companion ring 41 is generally flat. Rearward side surface 55 of companion ring 41 follows the curvature of the side of seal 29 and is generally curved for mating contact. In certain embodiments, the height of companion ring 41 between forward side surface 53 and rearward side surface 55 is less than the height of seal 29. In certain embodiments, the height of companion ring 41 is less than the distance between the outer diameter of companion ring 41 and inner diameter of companion ring 41. In certain embodiments, first companion ring 41 is permeable to a fluid compatible with the lubricant. First companion ring 41 preferably does not sealingly engage seal groove base 34 and bearing pin 15. In certain embodiments, first companion ring 41 is soaked or impregnated with a fluid compatible with the lubricant lubricating the bearing pin 15 prior to installation.

Optionally, a second companion ring 83 formed of a porous material and having an outer diameter 84 that contacts seal groove base 34 and an inner diameter 86 that contacts bearing pin 15. In certain embodiments, outer diameter surface 84 and inner diameter surface 86 are generally cylindrical. In other embodiments, outer diameter surface 84 and inner diameter surface 86 are generally straight. In yet other embodiments, outer diameter surface 84 and inner diameter surface 86 are generally arcuate. Forward side surface 88 of second companion ring 83 follows the curvature of the side of seal 29 and is generally curved. Rearward side surface 90 of second companion ring 83 is generally flat. In certain embodiments, the height of second companion ring 83 between forward side surface 88 and rearward side surface 90 is less than the height of seal 29. In certain embodiments, the height of second companion ring 83 is less than the distance between outer diameter 84 of the second companion ring and inner diameter 86 of the companion ring. In certain embodiments, the second companion ring 83 is permeable to a fluid compatible with the lubricant. Preferably, first companion ring 41 and second companion ring 83 do not form a sealing engagement with seal groove base 34 and bearing pin 15. In certain embodiments, second companion ring 83 is not soaked or impregnated with a fluid compatible with the lubricant lubricating the bearing pin 15 prior to installation.

In certain embodiments, companion ring 41 supplies grease or other lubricant to the seal, such as for example, when the seal begins to wear. In certain embodiments, companion ring 83 prevents drill cuttings and drilling fluids, such as for example, aqueous or non-aqueous based drilling muds, from entering the cone cavity. In certain embodiments companion ring 83 prevents drill cuttings and drilling fluids from contacting the seal. In certain embodiments, first companion ring 41 is a foam material and second companion ring 83 is a felt material. In certain embodiments, first companion ring 41 is a felt material and second companion ring 83 is a foam material. In other embodiments, first companion ring 41 and second companion ring 83 are a felt material. In certain embodiments, first companion ring 41 and second companion ring 83 are a foam material.

In certain embodiments, the seal may include notch or recess in either the forward or rearward side surface adjacent to companion ring forward side surface adapted to matingly receive a pin or tab positioned on the adjacent side surface of companion ring. The mating engagement of notch or recess with pin or tab on the companion ring allows for the seal and companion ring to be coupled to one another. Alternatively, the notch or recess can be located on the forward side surface of the companion ring and the pin or tab can be located on the rearward side surface of the seal.

In certain embodiments, the seals can be formed entirely from a single elastomeric material. In other embodiments, the seal body can be formed of one material and the seal surfaces contacting either the bearing pin or the cone cavity can be a different material.

Figure 8:
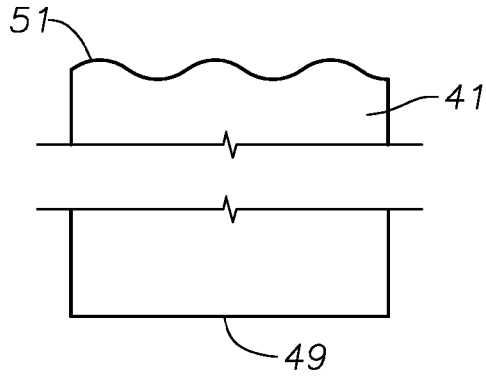
FIG. 8 is a cross sectional view of the inner diameter of a seal in accordance with another embodiment of the invention.

A variety of different surface textures can be employed on companion ring 41. In certain embodiments, as shown in FIG. 8, companion ring 41 can include one or more undulating or wavy ridges that traverse inner diameter surface 51 of companion ring 41. In other embodiments, the outer diameter of companion ring 41 can include a textured surface. In yet other embodiments, both inner 51 and outer 49 diameters of companion ring 41 can include a textured surface. The undulating wavy textured surface can apply varying pressure in the circumferential direction at the inner diameter of seal 29. In certain embodiments, the textured or wavy surface has a height of less than about 400 microns. In certain embodiments, the textured or wavy surface has a height is between about 100 and 400 microns. In certain embodiments, textured surface 43 is in sliding engagement with the bearing pin and the waviness generates pumping action to lubricate the inner diameter surface 37 of the seal 29.

In certain embodiments, companion ring 41 has a height less than the height of seal 29. In certain embodiments, companion ring 41 does not create a seal with bearing pin 15, but instead provides a surface that prevents the unwanted migration of debris into the seal, but allows the passage of fluid. In certain embodiments, textured surface blocks the passage of debris. In other embodiments, textured surface traps debris. In yet other embodiments, textured surface 3 promotes hydrodynamic lubrication of the fluid.

In certain embodiments, as shown in FIG. 2, outer diameter 35 of seal 29 and outer diameter 49 of companion ring 41 are approximately equivalent. In certain other embodiments, inner diameter 37 of seal 29 and inner diameter 51 of companion ring 41 are approximately equivalent.

Although the following detailed description contains many specific details for purposes of illustration, one of ordinary skill in the art will appreciate that many variations and alterations to the following details are within the scope and spirit of the invention. Accordingly, the exemplary embodiments of the invention described herein are set forth without any loss of generality to, and without imposing limitations thereon, the present invention.

As used herein, optional or optionally means that the subsequently described event or circumstances may or may not occur. The description includes instances where the event or circumstance occurs and instances where it does not occur.

As used herein, recitation of the term about and approximately with respect to a range of values should be interpreted to include both the upper and lower end of the recited range. Ranges may be expressed herein as from about one particular value, and/or to about another particular value. When such a range is expressed, it is to be understood that another embodiment is from the one particular value and/or to the other particular value, along with all combinations within said range.

As used in the specification and claims, the singular form "a", "an" and "the" may include plural references, unless the context clearly dictates the singular form.

Although the following detailed description contains many specific details for purposes of illustration, one of ordinary skill in the art will appreciate that many variations and alterations to the following details are within the scope of the invention. Accordingly, the exemplary embodiments of the invention described below are set forth without any loss of generality to, and without imposing limitations thereon, the claimed invention.

Throughout this application, where patents or publications are referenced, the disclosures of these references in their entireties are intended to be incorporated by reference into this application, in order to more fully describe the state of the art to which the invention pertains, except when these reference contradict the statements made herein.

The invention claimed is:

1. An earth boring bit, comprising:

a bit body having a depending bearing pin;

a cone having a plurality of cutting elements for engaging a bore hole, the cone having a cavity that rotatably engages the bearing pin, the cone and the bearing pin having a seal area denied by two annular surfaces, one of which rotates relative to the other;

a seal positioned between the bearing pin and the cone cavity in sealing engagement with the annular surfaces of the seal area;

said seal having a forward side surface and a rearward side surface; and a first companion ring abutting one of the side surfaces of the seal, the first companion ring being positioned between the bearing pin and the cone cavity in non-sealing engagement with the annular surfaces of the seal area, wherein the first companion ring is a permeable material.

2. The earth boring bit of claim 1, wherein the first companion ring is impregnated with a fluid compatible with a lubricant lubricating the bearing pin.

3. The earth boring bit of claim 1, wherein the first companion ring is positioned between the forward side surface of the seal and a forward side of the seal area.

4. The earth boring bit of claim 3, further comprising a second companion ring, wherein the second companion ring is positioned between the rearward side surface of the seal and a rearward side of the seal area in non-sealing engagement with the annular surfaces of the seal area.

5. The earth boring bit of claim 1, wherein the first companion ring is positioned between the rearward side surface of the seal and a rearward side of the seal area.

6. The earth boring bit of claim 1, wherein the first companion ring comprises an inner diameter that contacts, but does not seal the bearing pin, and an outer diameter that contacts, but does not seal the cone.

7. The earth boring bit of claim 1, wherein the first companion ring includes an inner diameter and an outer diameter, said inner diameter comprising a non-contiguous contact pattern where said companion ring contacts the bearing pin.

8. The earth boring bit of claim 1, wherein the first companion ring comprises a first material selected from the group consisting of polyethylene microfibers, polypropylene microfibers, fiberglass, polyester, and a polyethylene terephthalate/polypropylene composite material.

9. The earth boring bit of claim 1, wherein:

the first companion ring has a forward side and a rearward side, and wherein the forward side of the first companion ring is formed of a porous material and the rearward side of the first companion ring is formed of a second material, wherein said second material has a greater density than the porous material.

10. The earth boring bit of claim 1, wherein the first companion ring comprises a layered structure, said layered structure comprising an inner core, a forward side surface material and a rearward side surface material, said inner core having a density greater than the density of the forward and rearward side surface materials.

11. An earth boring bit, comprising:

a bit body having a depending bearing pin;

a cone having a plurality of cutting elements for engaging a bore hole, the cone having a cavity that rotatably engages the bearing pin; and a groove formed in the cavity of the cone and having a forward side surface, a rearward side surface and a base:

a seal in the groove, said seal having an outer diameter that sealingly engages the base of the groove and an inner diameter that sealingly engages the bearing pin, the seal having a forward side surface and a rearward side surface;

a first companion ring adjacent to one of the side surfaces of the seal, said first companion ring comprising a material permeable to liquids; and wherein the height of the groove is greater than the combined height of the seal and companion ring.

12. The earth boring bit of claim 11 wherein the first companion ring is impregnated with a fluid compatible with a lubricant operable for lubricating the interface between the bearing pin and the cone cavity.

13. The earth boring bit of claim 12 further comprising a second companion ring, wherein the second companion ring is positioned between the rearward side surface of the seal and a rearward side of the seal groove.

14. The earth boring bit of claim 11 wherein said first companion ring is porous.

15. The earth boring bit of claim 11 wherein the first companion ring is located between the forward side surface of the seal and the forward side surface of the seal groove.

16. The earth boring bit of claim 11 wherein the first companion ring is located between the rearward side surface of the seal and the rearward side surface of the seal groove.

17. The earth boring bit of claim 11 wherein the first companion ring comprises a first material selected from the group consisting of polyethylene microfibers, polypropylene microfibers, fiberglass, polyester, and a polyethylene terephthalate/polypropylene composite material.

18. The earth boring bit of claim 11 wherein:

the first companion ring has a forward side and a rearward side, wherein the forward side comprises a permeable material the rearward side is formed of a second material, wherein the second material has a greater density than the permeable material.

19. The earth boring bit of claim 11 wherein the inner diameter of the first companion ring comprises a non-contiguous contact pattern where the first companion ring contacts the bearing pin.

20. An earth boring bit, comprising:

a bit body having a depending bearing pin;

a cone having a plurality of cutting elements for engaging a bore hole, the cone having a cavity that rotatably engages the bearing pin, the cone and the bearing pin having a seal area defined by two annular surfaces, one of which rotates relative to the other;

an elastomeric seal having a forward side surface, a rearward side surface and positioned between the bearing pin and the cone cavity in sealing engagement with the annular surfaces of the seal area;

a first companion ring abutting the rearward side surface of the seal and positioned between the bearing pin and the cone cavity in non-sealing engagement with the annular surfaces of the seal area, wherein the first companion ring is felt material; and a second companion ring abutting the forward side surface of the seal and positioned between the bearing pin and the cone cavity in non-sealing engagement with the annular surfaces of the seal area, wherein the second companion ring is foam material.

* * * * *

UNITED STATES PATENT AND TRADEMARK OFFICE

CERTIFICATE OF CORRECTION

PATENT NO. : 7,896,109 B2
APPLICATION NO. : 12/251000
DATED : March 1, 2011
INVENTOR(S) : Chih Lin It is certified that error appears in the above-identified patent and that said Letters Patent is hereby corrected as shown below:

Column 2, line 57, delete “are” after “seal” and insert --area--
Column 4, line 43, after “material” insert --and--
Column 8, line 13, after “height” insert --that--

IN THE CLAIMS:

Claim 18, Column 10, line 38, after “material” insert a --,--

Signed and Sealed this
Twenty-first Day of June, 2011

David J. Kappos

David J. Kappos
*Director of the United States Patent and Trademark Office*